US006044788A

United States Patent [19]

Larson et al.

[11] Patent Number: 6,044,788

[45] Date of Patent: Apr. 4, 2000

[54] WATER SPORTS PERFORMANCE SYSTEM AND METHOD

[75] Inventors: Borden M. Larson; William N. Snook, both of Orlando, Fla.

[73] Assignee: Correct Craft, Inc., Orlando, Fla.

[21] Appl. No.: 09/037,172

[22] Filed: Mar. 9, 1998

[51] Int. Cl.[7] ..... B63B 21/56

[52] U.S. Cl. ..... 114/253; 114/125; 114/242

[58] Field of Search ..... 114/125, 242, 114/253, 254, 255

[56] References Cited

U.S. PATENT DOCUMENTS

| | | | |
|---|---|---|---|
| D. 195,068 | 4/1963 | Griparis . | |
| 2,821,726 | 2/1958 | Correll . | |
| 3,034,470 | 5/1962 | Vanderfeltz et al. . | |
| 3,122,609 | 2/1964 | Moore | 114/253 |
| 3,336,894 | 8/1967 | Eisner . | |
| 3,503,358 | 3/1970 | Moesley . | |
| 3,724,595 | 4/1973 | Green . | |
| 3,802,374 | 4/1974 | Brown . | |
| 3,811,143 | 5/1974 | Page . | |
| 3,890,918 | 6/1975 | Sell . | |
| 3,925,836 | 12/1975 | Simmonds . | |
| 3,949,698 | 4/1976 | Sell . | |
| 4,033,280 | 7/1977 | Wood et al. | 114/255 |
| 4,163,529 | 8/1979 | Krenzer et al. . | |
| 4,341,177 | 7/1982 | Miyazaki et al. . | |
| 4,528,927 | 7/1985 | Iizuka et al. . | |
| 4,561,375 | 12/1985 | Paxton . | |
| 4,641,597 | 2/1987 | Paxton . | |
| 4,694,773 | 9/1987 | Sparkes et al. . | |
| 4,893,577 | 1/1990 | Jennings . | |
| 5,018,474 | 5/1991 | Jellen . | |
| 5,050,517 | 9/1991 | Kobayashi . | |
| 5,052,326 | 10/1991 | Wiggen et al. . | |
| 5,105,754 | 4/1992 | Collins . | |
| 5,215,025 | 6/1993 | Talmor . | |
| 5,520,133 | 5/1996 | Wiegert . | |
| 5,520,139 | 5/1996 | King et al. . | |
| 5,645,003 | 7/1997 | Grinde . | |
| 5,673,507 | 10/1997 | Stokes, Jr. . | |
| 5,787,835 | 8/1998 | Remnant | 114/125 |
| 5,934,217 | 8/1999 | Allsop | 114/242 |
| 5,943,977 | 8/1999 | Womack et al. | 114/242 |

OTHER PUBLICATIONS

Alan Jones, A Star is Born, Boating World, Sep. 1997, pp. 33–34.

*Primary Examiner*—Sherman Basinger

*Attorney, Agent, or Firm*—Allen, Dyer, Doppelt, Milbrath & Gilchrist, P.A.

[57] ABSTRACT

Aerial characteristics in a wakeboard performance are improved with a vessel having a skeletal frame including starboard and port rigid vertical support structures fitted to opposing sides of the vessel with a horizontal bridging portion extending between the structures for attaching a tow rope. Further, ballast tanks are fitted onboard and only aft amidships of the vessel, at or above the waterline. The ballast tanks are filled with water during movement of the vessel using a water scoop which extracts water from the body of water upon which the vessel operates and forces the water into the ballast tanks during movement of the vessel through the body of water, weighting down the stern, thus lowering the vessel into the body of water and affecting the wake created by the vessel. By controlling the amount of water carried by the tanks, a desirable wake is formed for use by the performer. The weighting is controlled by controlling air venting to the ballast tanks. The tanks are emptied while the vessel is stopped, permitting them to drain.

56 Claims, 6 Drawing Sheets

WATER SPORTS PERFORMANCE SYSTEM AND METHOD

FIELD OF INVENTION

The present invention generally relates to towing of a performer by a vessel, and more particularly to enhancing performance of the performer using a water sport implement using ballast for providing a desirable wake for the performer while maintaining stability of the vessel.

BACKGROUND OF THE INVENTION

Wakeboarding has become one of the fastest growing sports in the world. In the sport of wakeboarding, there is an ever increasing need for the tow boat to create a larger wake to ride. Unlike waterskiing, the performer on a wakeboard is looking for as large a wake as possible. Further, by anchoring the tow line at a high elevation above the boat deck, the greater the ability of the performer to lift higher into the air, whether with a ski or wakeboard.

Tow rope pylons are known in the art, such as those described in U.S. Pat. No. 4,893,577 to Jennings and U.S. Pat. No. 4,641,597 to Paxton. A typical skiing and wakeboarding pylon has a height of approximately three feet to eight above the floor of the boat. Pylon heights have increased to accommodate the ever increasing height of jumps across the wake by wakeboarders. The extended pylons run a cable from the top of the pylon to the bow of the boat as a guy wire. This wire interferes with movement inside the boat. Further, these extended height pylons have not satisfied wakeboarders with their performance. They do give the performer the ability to get bigger air on the jumps, but the extended pylons flex too much when the performer cuts away or to the wake. During these cuts, the boat heels to a point of instability for the boat and a hazard for all concerned. The guy wire provides support when the skier is pulling straight back, but offers less support when the skier is pulling from the side.

The simplest way to increase the size of the wake is to increase the amount of weight inside a boat. Typically, this has been done by adding lots of people. Alternatively, the industry's response has been to include water bladders in the boat or other weighting materials such as buckets filled with concrete, rocks, or sand.

In one bladder system, a liner is placed inside of a canvas sack or bag. Filling the liner full of water by use of a bilge pump with hoses, wires and clips, can add weight to the back of a boat. However, this process is awkward and cumbersome. Another attempt at adding weight to the back of a boat is believed to include two gates on a transom of a boat. A cable is pulled to open the two gates and thereby flood two tanks located behind the transom of the boat. The tanks are drained by opening the gates. This system required a four foot high boat hull, where typical sports towing boats have a transom or hull height of only thirty inches from bottom to top of the gunwale.

As described, by way of example with reference to U.S. Pat. No. 5,645,003 to Grinde, it is known to add water for ballasting, typically uniformly along the length of the boat or forward, as in U.S. Pat. No. 4,528,927 to Iizuka et al. for enhancing the planing of the vessel. Typically ballast pumps are used to control the amount of water within the ballasting, as described, by way of example, with reference to U.S. Pat. No. 5,215,025 to Talmor.

It is typically thought that by simply adding more weight to the boat, the wake will become bigger and better.

However, the shape of the wake is as important as the size. The perfect slope, length and hardness of the lip of a wake are also important to enable the performer to release from the wake and achieve a desired launch into the air. Further, it is important that wake control be done in a relatively rapid and timely manner, not available with use of a typical ballast pump.

SUMMARY OF THE INVENTION

In view of the foregoing background, it is therefore an object of the present invention to improve the aerial characteristics of a performance by a performer using a water sport implement, such as a wakeboard or ski, by way of example, by providing a controllable and desirable wake for the performer while maintaining the stability of the vessel.

This and other objects, features, and advantages of the invention, are provided by a water sports system comprising a vessel behind which the performer is to be towed, the vessel including a bow, a stern and an operator station between opposing sides. A vertical support unit is fitted to the vessel and includes an upper portion for securing a tow rope at a height above the level of the operator station. A ballast tank is fitted onboard and only at the stern of the vessel, Further, extracting means in fluid communication with the body of water over which the vessel operates is used for forcing water into the ballast tank. Water in the ballast tank weights down the stern of the vessel, thus lowering it and controlling a wake created by the vessel.

Various support units will operate with the system. One preferred unit comprises a first relatively rigid vertical support structure fitted to a first one of the sides of the vessel, a second relatively rigid vertical support structure fitted to a second one of the sides, and a generally horizontal bridging portion extending between upper portions of the first and second vertically extending support structures at the height above the level of the operator station. Another vertical support unit comprises a forward relatively rigid U-shaped support structure fitted across the beam of the vessel and substantially above the level of the operator station, an aft relatively rigid U-shaped support structure fitted across the beam of the vessel and substantially above the level of the operator station, and at least one transversely extending relatively rigid bar attached between the forward and aft U-shaped structures, which U-shaped structures and the at least one rigid bar, in combination, form a skeletal frame for attaching the tow rope thereto. Yet another vertical support unit comprises a pylon extending from the floor of the vessel and having an upper portion adapted for securing a tow rope thereto.

In a preferred embodiment, a tow rope connecting element is attached to the upper portion of the vertical support unit for attaching the tow rope thereto. Attaching means are provided for attaching the vertical support unit to the vessel, so as to permit the unit to be rotated so that the vessel may pass underneath a bridge or into a boat house.

A lower most portion of the ballast tank is fitted at the waterline of the vessel when the tank is substantially empty of water to facilitate emptying of the tank. A preferred embodiment of the ballast tank includes an enclosed tank having an opening for venting air to the enclosed tank and further comprises valve means operable with the opening for controlling air venting to the ballast tank. The extracting means in a preferred embodiment comprises a water scoop positioned for extracting the water from the body of water as the vessel moves through the body of water. A pump is an alternate extracting means for independent use or use in complement with the water scoop.

In a preferred embodiment, the ballast tank comprises starboard and port enclosed ballast tanks. Each of the starboard and port enclosed ballast tanks comprises a generally L-shaped tank portion having a first elongated leg fitted beneath quarter gunwales of the vessel and a second leg fitted along an inboard side of the transom of the vessel. An opening is within each of the starboard and port tanks for venting air to each tank, and valve means are operable with the openings for independently controlling air venting to each of the tanks.

A method aspect of the present invention for improving performance while maintaining stability of the vessel includes fitting the vertical support unit to the vessel, attaching a tow rope to the upper portion of the vertical support unit for towing the performer therefrom, and fitting the ballast tank onboard and only at the stern of the vessel. While towing the performer over a body of water, water is extracted from the body of water and deposited into the ballast tank thus weighting down the stern of the vessel and lowering the vessel stern. A desired wake is formed for the performer by controlling an amount of the water to be deposited into the ballast tank.

In one embodiment, the ballast tank fitting step includes fitting a lower most portion of the ballast tank at the waterline of the vessel when the tank is substantially empty of the water. The ballast tank includes an enclosed tank having an opening for venting air to the enclosed tank. Controlling the air venting to the ballast tank controls the filling of the tank. The extracting of water from the body of water upon which the vessel operates comprises positioning a water scoop for extracting the water as the vessel moves through the body of water.

BRIEF DESCRIPTION OF DRAWINGS

A preferred embodiment of the invention and alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited by the embodiments set forth herein. Rather, these embodiments are provided so that this disclosure will be thorough and complete, and will fully convey the scope of the invention to those skilled in the art. Like numbers refer to like elements throughout.

Figure 1:
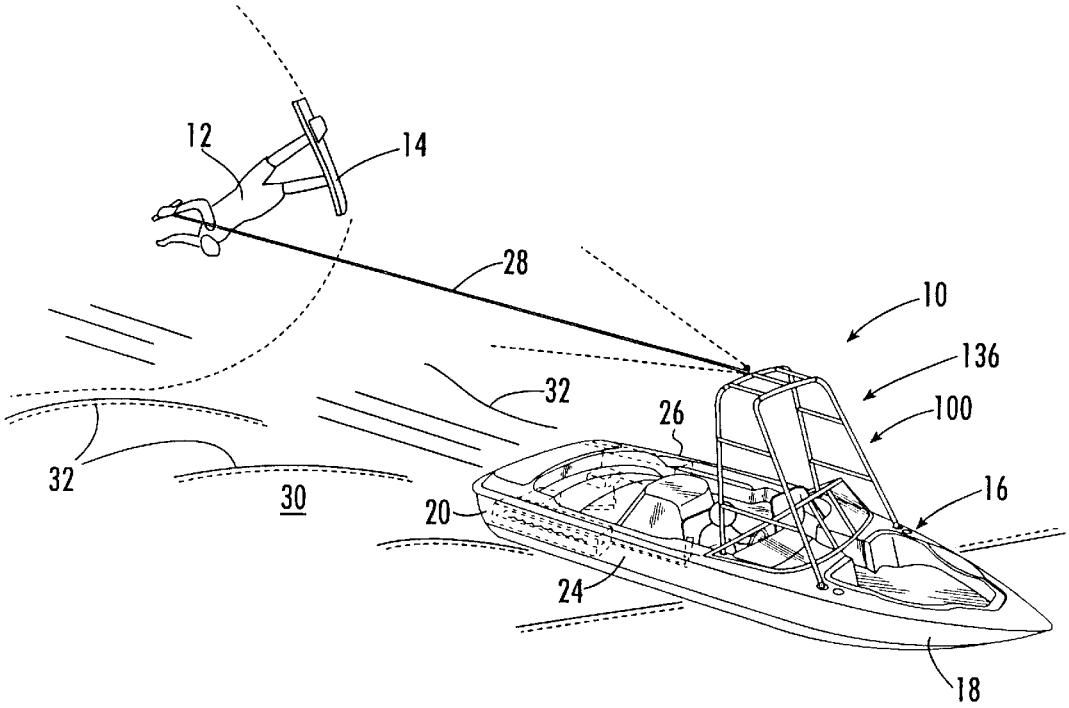
FIG. 1 is a perspective view of a vessel and performer in accordance with the present invention.
Figure 2:
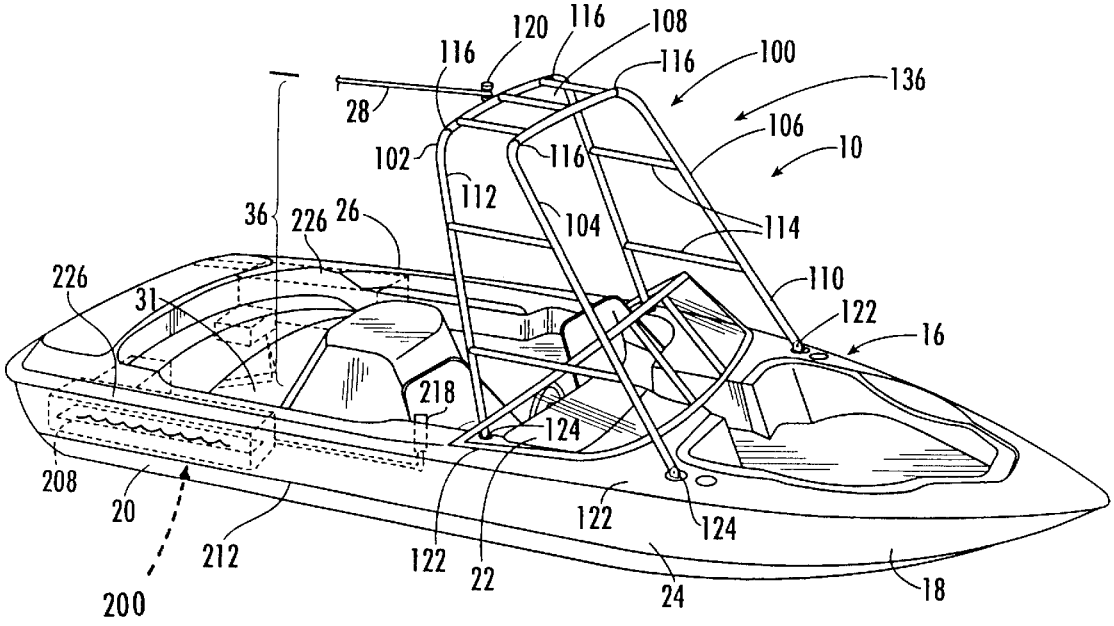
FIG. 2 is an enlarged perspective view of the vessel of FIG. 1 with rear ballast tanks illustrated.
Figure 3:
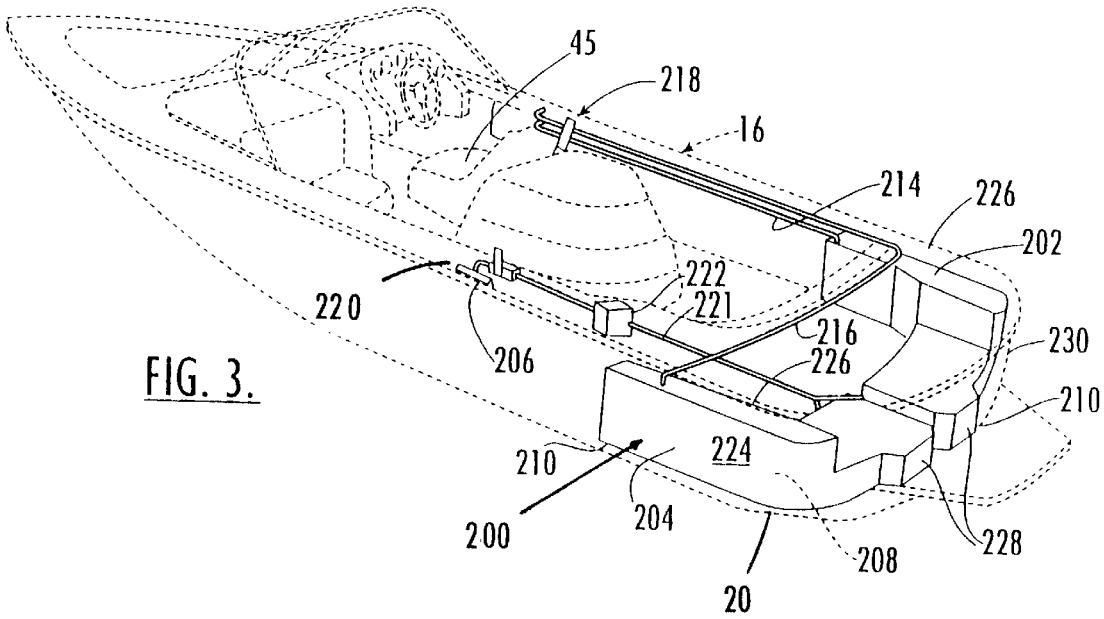
FIG. 3 is a partial perspective view of the ballast tanks carried within the vessel.

Referring now initially to FIGS. 1–3, a preferred embodiment of the present invention is herein described, by way of example, by a water sports system 10 for improving aerial characteristics of a performance by a performer 12 using a water sports implement such as a wakeboard 14. The system 10 comprises a vessel 16 behind which the performer 12 is to be towed. The vessel 16 includes a bow 18, a stern 20, and an operator station 22 between opposing starboard and port sides 24, 26. A towing structure referred herein as a vertical support unit 100 is fitted to the vessel 16. The vertical support unit 100, as will be further described later in this section, includes an upper portion 102 at a height above the level of the operator station 22 and is adapted for securing a tow rope 28 thereto. The tow rope 28 is attached to the upper portion 102 of the vertical support unit 100 for towing the performer 12, as illustrated again with reference to FIG. 1. The system 10 further includes a ballast assembly 200 which includes starboard and port ballast tanks 202, 204 fitted onboard and only aft, preferably within only the stern 20, extending from the transom toward amidships of the vessel 16, unlike typical ballast systems which fully extend bow to stern. Alternate embodiments include a single ballast tank. An extractor 206 is fitted to the hull of the vessel 16 and is in fluid communication with the body of water 30 within which the vessel operates for forcing water 208 into the ballast tanks 204, 202 and weighting down the aft portion of the vessel 16, thus lowering the vessel and controlling a wake 32 created by the vessel.

It is to be noted that various sized vessels will have varying length ballast tanks for extending the tank from the transom area to toward amidships to provide a desirable wake. Simply weighting down the vessel stern only proximate the transom leads to excess plowing of the vessel and an undesirable wake. Further, displacement boats having ballast from stern to bow, typically do not permit planing, desirable in a sports towing vessel. As a result, a certain amount of planing is to be maintained. By extending the ballast tank as herein described, an effective vessel performance and wake is achieved. Without deviating from the invention, alternate embodiments are now herein described.

With regard to the vertical support unit 100, reference being made again to FIG. 2, the vertical support unit comprises a first relatively rigid vertical support structure 104 fitted to the starboard side 24 of the vessel 16, a second relatively rigid vertical support structure 106 fitted to the port side 26, and a generally horizontal bridging portion 108 extending between upper extremities of the first and second vertically extending support structures at a desired height above the level of the operator station 22. In a preferred embodiment, the vertical support unit 100 forms a skeletal frame, as illustrated again with reference to FIG. 2, which has a forward relatively rigid U-shaped support structure 110 and an aft relatively rigid U-shaped support structure 112, both fitted across the beam of the vessel 16. Longitudinally extending rigid bars 114 are attached between the forward and aft U-shaped structures. In a preferred embodiment, the bars are generally horizontal and parallel to the floor 34 of the vessel 16, as illustrated with reference again to FIG. 2, by way of example. Such a frame transfers forces generated by towing the performer to the gunwales, by way of example, and provides a rigid anchoring of the tow rope to the vessel for improving over typical single tow bar devices referred to earlier in this specification. For convenience in shipping, the bridging portion 108 is separable from the vertical support structures 104, 106 at connections 116. In general, the preferred embodiment is made from generally rigid aluminum tubing with elements of the unit 100 welded to each other to form a generally rigid skeletal frame.

Figure 4:
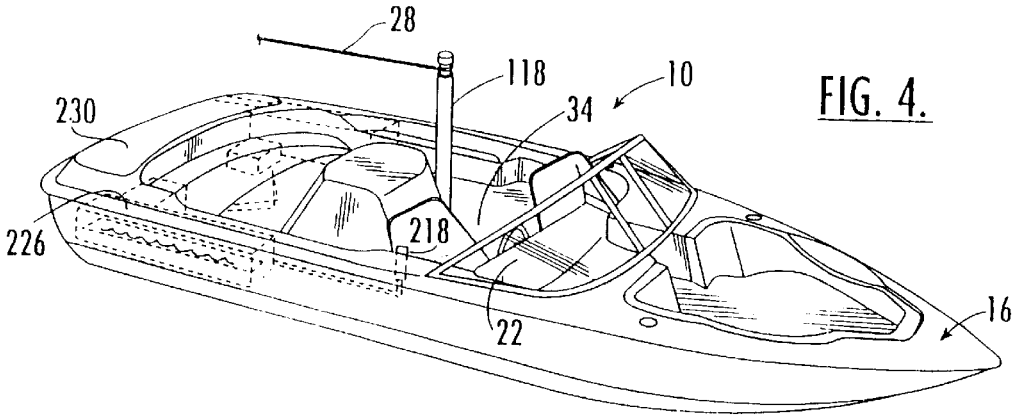
FIG. 4 is a perspective view of an alternate embodiment.
Figure 5:
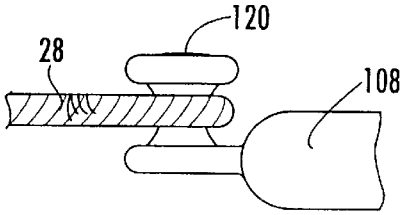
FIG. 5 is a partial side view of a towing element of the present invention.

In yet another embodiment, and with reference to FIG. 4, the vertical support unit 100 comprises a pylon 118 extending from the floor 34 of the vessel 16 and having an upper portion adapted for securing the tow rope 28 thereto. As illustrated again with reference to FIG. 2, and illustrated further with reference to FIG. 5, a tow rope connecting element 120 is attached to the upper portion of the vertical support unit 100, preferably to the horizontal bridging port 108 of the aft U-shaped support structure 112 for attaching the tow rope 28 thereto. The tow rope connecting element is mounted at a height 36 between 6'3" and 7 feet above the floor 34 of the vessel 16, but it is expected that other heights will be selected by those skilled in the water sports arts. At this height 36, passengers on the vessel can comfortably walk under the U-shaped support structure 112 and the tow line 28 extending rearwardly from the boat for pulling the performer 12 while, at the same time, maintaining stability for the vessel 16 as the performer maneuvers around the vessel during the performance.

Figure 6:
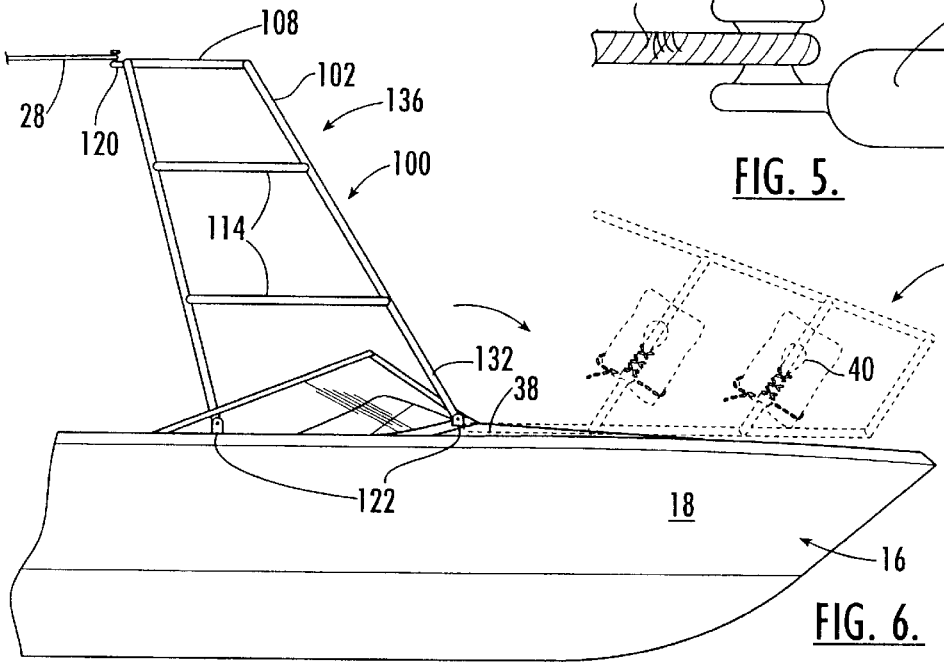
FIG. 6 is a partial side view of the embodiment of FIG. 2 illustrating an operating erected position and a rotated storing position of a towing structure of the present invention.
Figure 7:
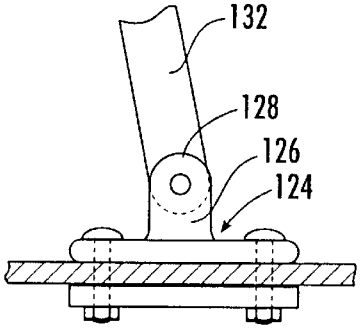
FIG. 7 is a partial side view of an attachment portion of the towing structure of FIG. 6.
Figure 8:
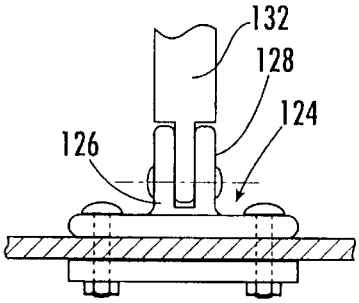
FIG. 8 is a partial front view of FIG. 7.
Figure 11:
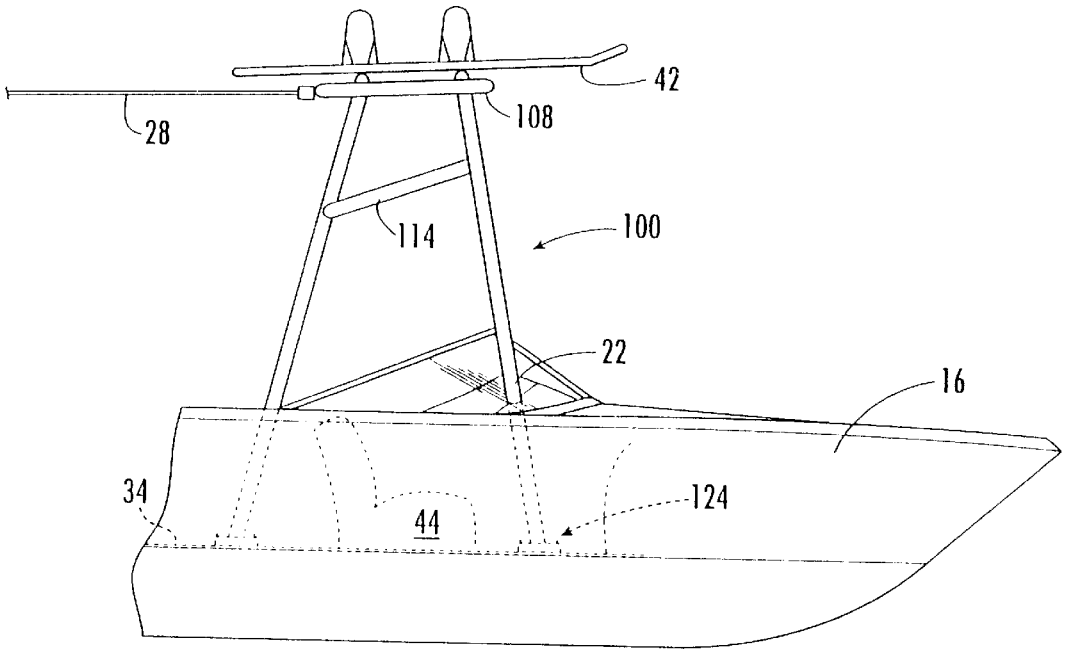
FIG. 11 is a partial side view of an alternate embodiment of FIG. 2.

The skeletal frame is an improvement over the pylon by providing a generally more rigid unit 100 secured to four mounting locations 122 at sides 24, 26 of the vessel 16. In a preferred embodiment of the invention, the vertical support unit 100, as illustrated with reference again to FIG. 2, and to FIGS. 6–8, the system 10 further comprises attaching the vertical support unit 100 to vessel deck portions and gunwales 38, so as to permit the unit to be rotated when the vessel needs to pass underneath a bridge or into a boat house, by way of example. In a preferred embodiment, anchoring plates 124 are located about the operator station 22. The anchoring plates 124 each include a shaft 126 which terminates in a free end 128 having a through hole for receipt of a pivot pin or bolt 130. Removably and rotatably mounted on the anchoring shafts 126 are lower extremities 132 of the skeletal frame, as illustrated with reference again to FIGS. 7 and 8. As illustrated with reference to FIG. 11, an alternate arrangement includes mounting the plates 124 to the floor 34 of the vessel 16.

Trailering of the vessel is made more convenient with this rotating feature. In the event the overall height of the unit 100 needs to be reduced for trailering, for example, the unit 100 is rotatable to a position 134 shown in dotted lines in FIG. 6 or is removable entirely from the vessel 16. As illustrated again with reference to FIGS. 7 and 8, the pin or bolt 130 is removed from the appropriate anchoring plates 124 for rotating the unit 100 onto the forward deck of the vessel or aft at the convenience of the operator.

Figure 9:
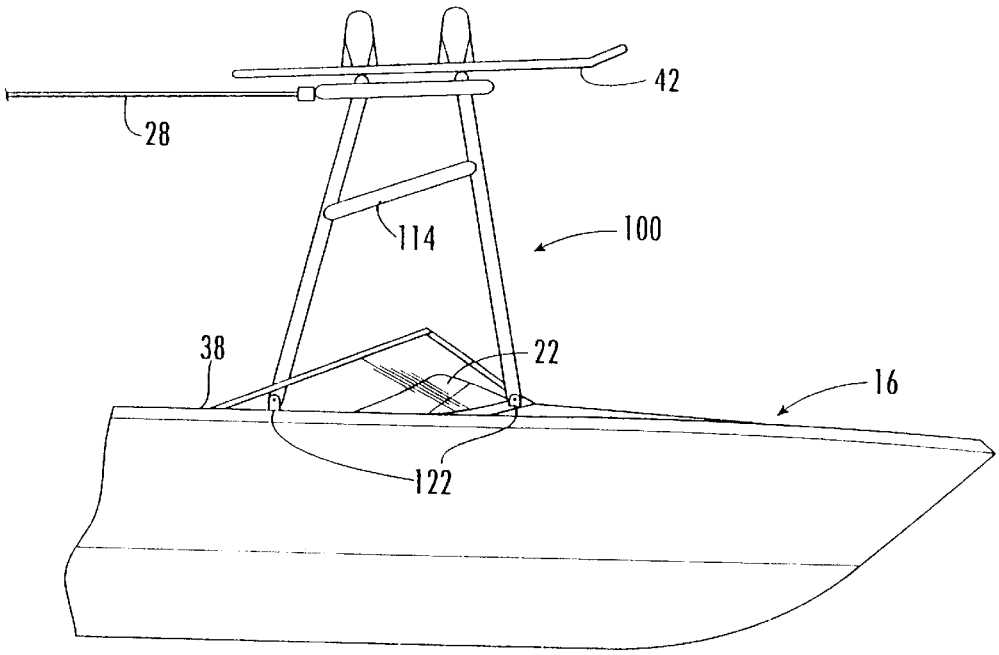
FIG. 9 is a partial side view of an alternate embodiment of FIG. 2.

In addition, it is convenient to use portions of the unit 100 to stow various pieces of equipment such as a life vest 40 or wakeboard 42 and other equipment as illustrated with reference again to FIG. 6 and FIG. 9. Further, the convenient mounting of stereo speakers is also accomplished. Such equipment is also conveniently stowed out of the way when unit 100 is in the erect position 136 as earlier described with reference to FIGS. 1 and 2.

Figure 10:
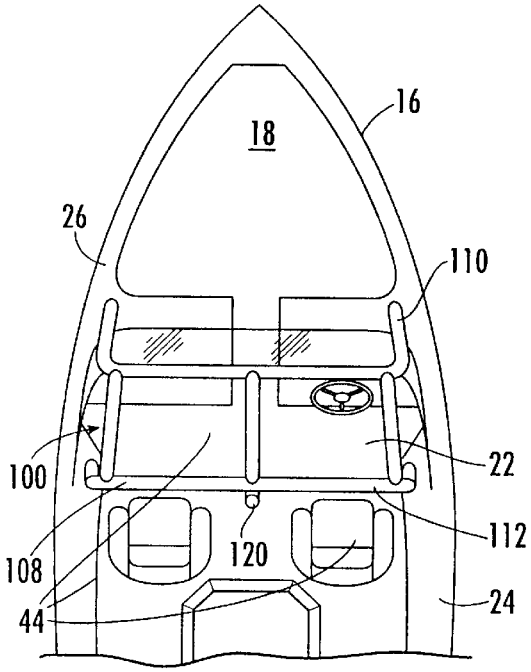
FIG. 10 is a partial top plan view of the embodiment of FIG. 2.
Figure 12:
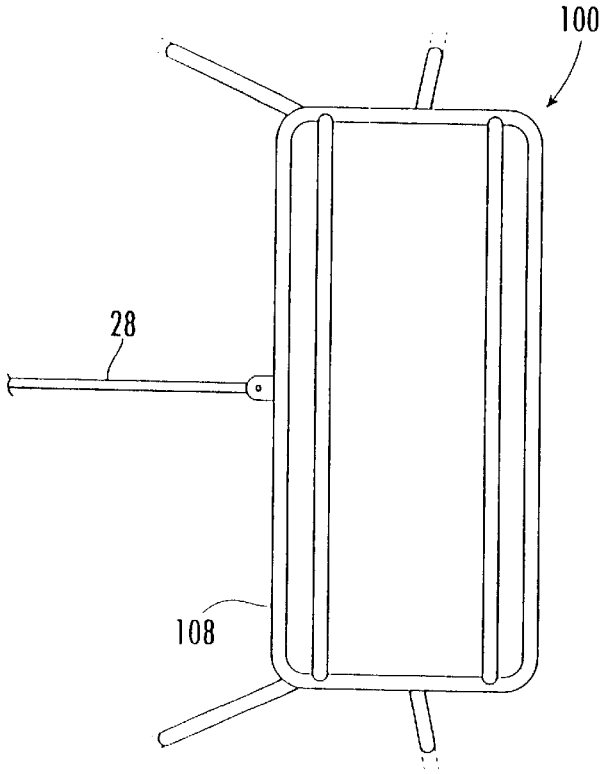
FIG. 12 is a partial top plan view of the embodiment of FIG. 11.
Figure 13:
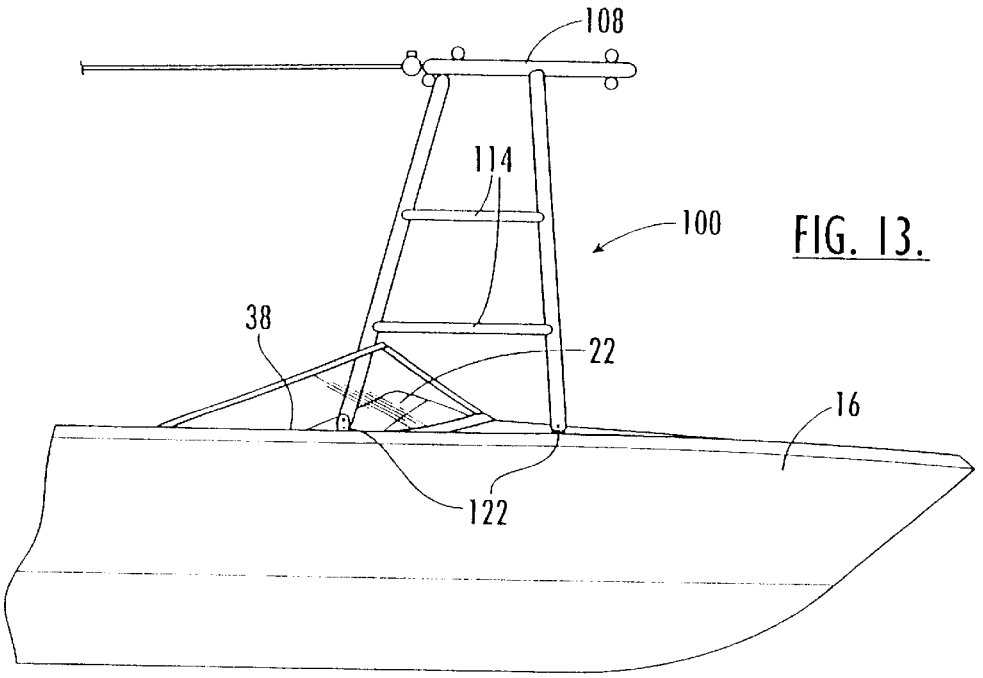
FIG. 13 is a partial side view of yet another embodiment of FIG. 2.

As illustrated with reference to FIG. 10, a clear line of sight is provided for individuals sitting in the seats 44 so as not to interfere with the steering of the vessel 16 or the maneuvering of passengers onboard. As illustrated, by way of example with reference to FIGS. 11–13, various embodiments for the unit 100 of the present invention are possible without deviating from the intent and value of the present invention.

Figure 14:
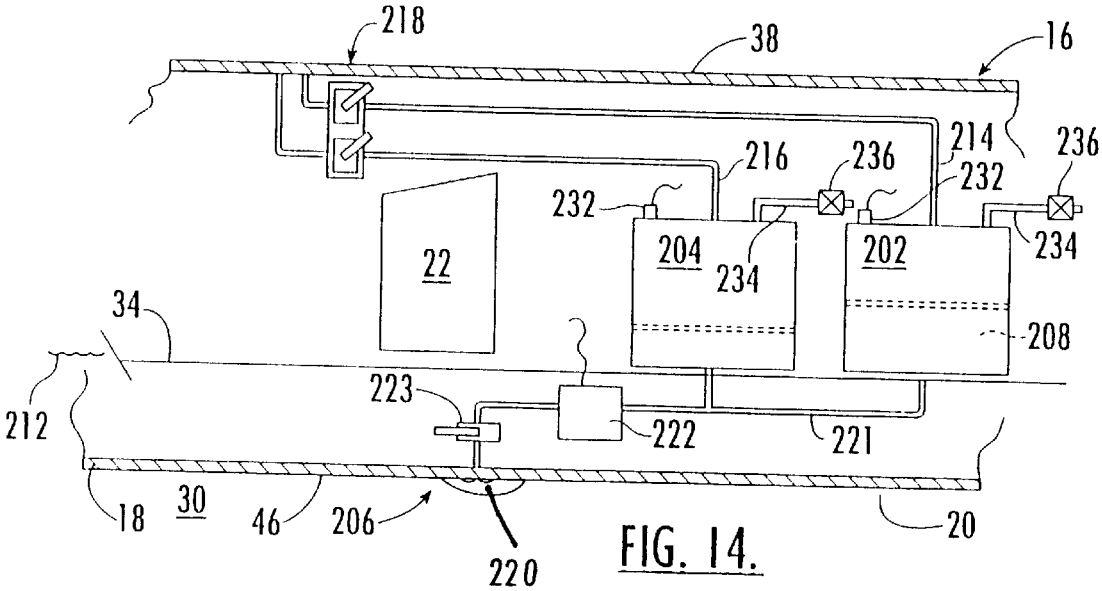
FIG. 14 is a schematic of a ballast tank control system of the present invention.

As illustrated with reference again to FIGS. 2–3, and to FIG. 14, a preferred embodiment of the system 10 and the ballast assembly 200, a lower most portion 210 of each of the ballast tanks 202, 204 is preferably fitted at the waterline 212 of the vessel 16 when the tanks are empty, typically the floor 34 for towing vessels as herein described.

In preferred embodiments of the ballast tanks 202, 204 and with reference again to FIGS. 3 and 14, the ballast tanks are enclosed and each have an opening arranged through vent lines 214, 216 for venting air into and out of each of the enclosed tanks 202, 204 respectively. Further, an air control valve 218 is within easy reach by the vessel operator for manually controlling air venting to each of the ballast tanks. It is anticipated that electrically, pneumatically or hydraulically operated control valves may be appropriate. The extractor 206, earlier described, includes a water scoop 220 positioned below the water line 212 and on the hull 46 of the vessel 16 for extracting the ballast water 208 from the body of water 30 as the vessel 16 moves through the body of water and delivering the ballast water 208 through a water intake line 221 connected between the scoop 220 and ballast tanks 202, 204. In an alternate embodiment, a two way pump 222 is placed within the line 221 and used for enhancing the extracting and dumping of the ballast water 208.

Further, a shut off valve 223 is fitted within the line 221. As illustrated again with reference to FIGS. 2 and 3, the ballast tanks 204, 208 comprise starboard and port enclosed ballast tanks wherein each of the starboard and port enclosed ballast tanks comprises a generally L-shaped tank having a first elongated leg 224 fitted beneath quarter gunwales 26 of the vessel 16 and a second leg 228 fitted along an inboard side of the transom 230.

As illustrated with reference again to FIG. 3, intermediate of the stern 20 and bow 18 is the operator's seat 45 within which the operator sits to control steering while viewing instruments. The air control valve 218 is within easy reach of the operator.

As illustrated again with reference to FIG. 14, the inlet line 221 leads to a water scoop 220 which collects the ballast water 208 as the vessel 16 is moved forward through the body of water 30. The water 208 collected in the scoop 220 is fed through the intake line 221 upon proper positioning of the valves 218, 223. If the shut off valve 223 is closed, no water 208 will be allowed to be fed into ballast tanks 202, 204. In addition, water 208, if already in ballast tanks 202, 204 will not be allowed to leave the tanks. However, if the water 208 is to be introduced into ballast tanks 202, 204, the shut off valve 223 must be opened and in addition, the respective air line control valve 218, independently controlling each of the air lines 214, 216 must be opened to allow air to escape from the ballast tanks as the water is being scooped up and fed into the tanks. Thus, if the air line control valve 218 is open, water 208 will be forced into ballast tanks 202, 204 as the boat is moving forward until the ballast tanks are full or the valves are closed. Excess water is forced through the air lines 214, 216 past the air line control valve 218 as one indication that the tanks are full. Alternatively, water level indicators 232 are used. Additionally, tank overflow tubes 234 fitted with one way check valves 236 deliver excess water overboard, as illustrated again with reference to FIG. 14. The overflow tubes 234 limit the maximum pressure in the tanks to a maximum static head. The check valves 236 stop air from flowing back in the tanks when the air control valve 218 is closed.

To remove the water 208 from the tanks 202, 204, the vessel comes to a stand still in a preferred method of dumping the ballast water. The shutoff valve 223 is then opened, with the opening of the air control valve 218 for allowing air into the air lines 214, 216. Through the forces of gravity, the water 208 flows out of the tanks 202, 204 through the intake line 221 and out through the opened shutoff valve 223 to the surrounding body of water 30.

Since the operator sitting in seat 45 has easy access to both valves 218, 223, the amount and shape of the wake 32, illustrated with reference again to FIG. 1, produced by the vessel 16 can be precisely controlled by the operator. By selectively shifting the ballast water 208 into and out of the tanks 202, 204, the wake 32 is produced to a controlled degree for optimum and desirable wakeboarding.

Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A water sports system for improving aerial characteristics of a performance by a performer using a water sports implement, the system comprising:

a vessel behind which the performer is to be towed, the vessel including a bow, a stern, opposing starboard and port sides between the bow and the stern, and an operator station located amidships between the opposing sides;

a vertical support unit fitted to the vessel at a location proximate the operator station and positioned amidships, the vertical support unit having an upper portion at a height substantially above the level of the operator station and adapted for securing a tow rope thereto;

a tow rope attached to the upper portion of the vertical support unit for towing the performer therefrom;

first and second ballast tanks fitted onboard at opposing locations proximate the starboard and port sides, respectively, and extending toward the stern from only aft amidships; and extracting means in fluid communication with the body of water for forcing water into the first and second ballast tanks for weighting down the vessel and controlling a wake created by the vessel.

2. The system according to claim 1, wherein the vertical support unit comprises:

a first relatively rigid vertical support structure fitted to the starboard side at the location proximate the operator station;

a second relatively rigid vertical support structure fitted to the port side at the location proximate the operator station; and a generally horizontal bridging portion extending between upper portions of the first and second vertically extending support structures at the height substantially above the level of the operator station.

3. The system according to claim 1, wherein the vertical support unit comprises:

a first relatively rigid U-shaped support structure fitted across the beam of the vessel at a point forward the operator station and extending substantially above the level of the operator station;

a second relatively rigid U-shaped support structure fitted across the beam of the vessel at a point aft the operator station and substantially above the level of the operator station; and at least one longitudinally extending relatively rigid bar attached between the forward and aft U-shaped structures, which U-shaped structures and the at least one rigid bar, in combination, form a skeletal frame for attaching the tow rope thereto.

4. The system according to claim 1, wherein the vertical support unit comprises a pylon extending from the floor of the vessel and having an upper portion adapted for securing a tow rope thereto.

5. The system according to claim 1, further comprising a tow rope connecting element attached to the upper portion of the vertical support unit for attaching the tow rope thereto.

6. The system according to claim 1, wherein a lower most portion of each of the first and second ballast tanks is fitted at or above the waterline of the vessel when the tanks are substantially empty of water.

7. The system according to claim 1, wherein each of the first and second ballast tanks comprises an enclosed tank having an opening for venting air to the enclosed tank.

8. The system according to claim 7, further comprising valve means operable with the opening for controlling air venting to the ballast tank.

9. The system according to claim 7, further comprising:

an opening within each of the starboard and port tanks for venting air to each tank; and valve means operable with the openings for controlling air venting to each of the tanks.

10. The system according to claim 1, wherein the extracting means comprises a water scoop positioned for extracting the water from the body of water as the vessel moves through the body of water.

11. The system according to claim 1, wherein the extracting means comprises a pump.

12. The system according to claim 1, further comprising attaching means for attaching the vertical support unit to the vessel, so as to permit the unit to be rotated so that the vessel may pass underneath a bridge or into a boat house.

13. The system according to claim 1, wherein each of the starboard and port ballast tanks comprises a generally L-shaped tank having a first elongated leg portion fitted beneath quarter gunwales of the vessel and a second leg portion fitted along an inboard side of the transom of the vessel.

14. A water sports system for improving aerial characteristics of a performance by a performer using a water sports implement, and being towed behind a vessel having a bow, a stern and an operator station between opposing sides, the system comprising:

a vertical support unit adapted to be fitted to the vessel, the vertical support unit having an upper portion for extending to a height substantially above the level of the operator station and adapted for securing a tow rope thereto;

first and second enclosed ballast tanks adapted to be fitted onboard along opposing starboard and port sides and only aft amidships of the vessel, the first and second ballast tanks having a length dimension for extending from amidships to proximate the stern of the vessel;

extracting means in fluid communication with the body of water for forcing water into each of the first and second ballast tanks for weighting down the vessel and controlling a shape of a wake created by the vessel; and valve means operable between the extracting means and the first and second enclosed ballast tanks for controlling air venting to the ballast tanks and thus flow of water into each tank.

15. The system according to claim 14, wherein the vertical support unit comprises:

a first relatively rigid vertical support structure adapted for fitting to the starboard side of the vessel at the location proximate the operator station;

a second relatively rigid vertical support structure adapted for fitting to the port side of the vesssel at the location proximate the operator station; and a generally horizontal bridging portion extending between upper portions of the first and second vertically extending support structures at the height substantially above the level of the operator station.

16. The system according to claim 14, wherein the vertical support unit comprises:

a first relatively rigid U-shaped support structure adapted for fitting across the beam of the vessel at a point forward the operator station and extending substantially above the level of the operator station;

a second relatively rigid U-shaped support structure adapted for fitting across the beam of the vessel at a point aft the operator station and extending substantially above the level of the operator station; and at least one longitudinally extending relatively rigid bar attached between the forward and aft U-shaped structures, which U-shaped structures and the at least one rigid bar, in combination, form a skeletal frame for attaching the tow rope thereto.

17. The system according to claim 14, wherein the vertical support unit comprises a pylon extending from the floor of the vessel and having an upper portion adapted for securing a tow rope thereto.

18. The system according to claim 14, further comprising a tow rope connecting element attached to the upper portion of the vertical support unit for attaching the tow rope thereto.

19. The system according to claim 14, wherein the extracting means comprises a water scoop positioned for extracting the water from the body of water as the vessel moves through the body of water.

20. The system according to claim 14, wherein the extracting means comprises a pump.

21. The system according to claim 14, further comprising attaching means for attaching the vertical support unit to the vessel, so as to permit the unit to be rotated so that the vessel may pass underneath a bridge or into a boat house.

22. The system according to claim 14, wherein each of the first and second enclosed ballast tanks comprises a generally L-shaped tank having a first elongated leg adapted for fitting beneath quarter gunwales of the vessel and a second leg adapted for fitting along an inboard side of the transom of the vessel.

23. A water sports system for improving aerial characteristics of a performance by a performer using a water sports implement, the system comprising:

a vessel behind which the performer is to be towed, the vessel including a bow, a stern, opposing starboard and port sides between the bow and the stern and an operator station located amidships between the opposing sides;

a skeletal frame including a first relatively rigid vertical support structure fitted to the starboard side of the vessel at a location proximate the operator station, a second relatively rigid vertical support structure fitted to the port side of the vessel at a location proximate the operator station, and a generally horizontal bridging portion extending between upper portions of the first and second vertically extending support structures at a height substantially above the level of the operator station, the skeletal frame adapted for securing a tow rope thereto;

a tow rope attached to the upper portion of the skeletal frame for towing the performer therefrom;

a ballast tank fitted onboard and only aft amidships of the vessel; and a water scoop in fluid communication with the body of water and operable with the ballast tank for forcing water into the ballast tank and weighting down the vessel, thus lowering the vessel aft portion and controlling a wake created by the vessel while permitting planing thereof, the water scoop extracting the water from the body of water as the vessel moves through the body of water.

24. The system according to claim 23, further comprising a tow rope connecting element attached to the upper portion of the skeletal frame for attaching the tow rope thereto.

25. The system according to claim 23, wherein a lower most portion of the ballast tank is fitted at or above the waterline of the vessel when the tank is substantially empty of water.

26. The system according to claim 23, wherein the ballast tank includes an enclosed tank having an opening for venting air to the enclosed tank.

27. The system according to claim 26, further comprising valve means operable with the opening for controlling air venting to the ballast tank.

28. The system according to claim 23, further comprising a pump in fluid communication with the water scoop.

29. The system according to claim 23, wherein the ballast tank comprises starboard and port enclosed ballast tanks.

30. The system according to claim 29, wherein each of the starboard and port enclosed ballast tanks comprises a generally L-shaped tank portion having a first elongated leg fitted beneath quarter gunwales of the vessel and a second leg fitted along an inboard side of the transom of the vessel.

31. The system according to claim 30, further comprising:

an opening within each of the starboard and port tanks for venting air to each tank; and valve means operable with the openings for controlling air venting to each of the tanks.

32. A water sports system for improving aerial characteristics of a performance by a performer using a water sports implement, the system comprising:

a vessel behind which the performer is to be towed, the vessel including a bow, a stern, opposing starboard and port sides between the bow and the stern, and an operator station between opposing sides;

a tow rope attached to the vessel for towing the performer therefrom;

first and second ballast tanks fitted onboard at opposing locations proximate the starboard and port sides and only aft amidships of the vessel, wherein a lower most portion of each of the first and second ballast tanks is fitted at or above the waterline of the vessel when the tanks are substantially empty of water;

a water scoop in fluid communication with the body of water for forcing water into each of the first and second enclosed ballast tanks for weighting down the vessel, thus lowering the vessel into the body of water and controlling a wake created by the vessel, the water scoop extracting the water from the body of water as the vessel moves through the body of water; and valve means operable between the extracting means and the first and second enclosed ballast tanks for controlling air venting to the ballast tanks and thus flow of water into each tank.

33. The system according to claim 32, wherein each of the first and second enclosed ballast tanks comprises a generally L-shaped tank having a first elongated leg fitted beneath quarter gunwales of the vessel and a second leg fitted along an inboard side of the transom of the vessel.

34. A method for improving aerial characteristics of a performance by a performer using a water sports implement and being towed behind a vessel, the method comprising the steps of:

providing a vessel behind which the performer is to be towed, the vessel including a bow, a stern opposing starboard and port sides between the bow and the stern and an operator station located amidships between the opposing sides;

fitting a vertical support unit to the vessel at a location proximate the operator station, the vertical support unit having an upper portion at a height substantially above the level of the operator station and adapted for securing a tow rope thereto;

attaching a tow rope to the upper portion of the vertical support unit for towing the performer therefrom;

fitting first and second ballast tanks onboard at opposing locations proximate the starboard and port sides, respectively, and only aft amidships of the vessel;

towing the performer over a body of water;

extracting water from the body of water and depositing the water into the first and second ballast tanks for weighting down the vessel and lowering the vessel into the body of water; and forming a desired wake to be used by the performer by controlling an amount of the water to be deposited into the first and second ballast tanks.

35. The method according to claim 34, wherein the vertical support unit fitting step comprises the steps of:

fitting a first relatively rigid vertical support structure to the starboard side at the location proximate the operator station;

fitting a second relatively rigid vertical support structure to the port side at the location proximate the operator station; and extending a generally horizontal bridging portion between upper portions of the first and second vertically extending support structures at the height substantially above the level of the operator station.

36. The method according to claim 34, wherein the vertical support unit fitting step comprises the steps of:

fitting a first relatively rigid U-shaped support structure across the beam of the vessel at a point forward the operator station and extending substantially above the level of the operator station;

fitting a second relatively rigid U-shaped support structure across the beam of the vessel at a point aft the operator station and extending substantially above the level of the operator station; and attaching at least one longitudinally extending relatively rigid bar between the forward and aft U-shaped structures, which U-shaped structures and the at least one rigid bar, in combination, form a skeletal frame for attaching the tow rope thereto.

37. The method according to claim 34, wherein the vertical support unit fitting step comprises the step of extending a pylon from the floor of the vessel, the pylon having an upper portion adapted for securing a tow rope thereto.

38. The method according to claim 34, further comprising a tow rope connecting element attached to the upper portion of the vertical support unit for attaching the tow rope thereto.

39. The method according to claim 34, wherein the ballast tanks fitting step includes fitting a lower most portion of each of the first and second ballast tanks at or above the waterline of the vessel when the tanks are substantially empty of the water.

40. The method according to claim 34, wherein each of the ballast tanks comprises an enclosed tank having an opening for venting air thereto.

41. The method according to claim 40, further comprising the step of controlling air venting to each of the ballast tanks for controlling the water depositing step.

42. The method according to claim 34, wherein the extracting step comprises the step of positioning a water scoop for extracting the water from the body of water as the vessel moves through the body of water.

43. The method according to claim 34, wherein the extracting step comprises the step of pumping the water into the ballast tank.

44. The method according to claim 34, further comprising the step of attaching the vertical support unit to the vessel so as to permit the unit to be rotated for passing underneath a bridge or into a boat house.

45. The method according to claim 34, wherein each of the first and second enclosed ballast tanks comprises a generally L-shaped tank having a first elongated leg portion fitted beneath quarter gunwales of the vessel and a second leg portion fitted along an inboard side of the transom of the vessel.

46. The method according to claim 45, further comprising the steps of:

venting each of the first and second tanks to air; and controlling air venting to each of the tanks.

47. A method for improving aerial characteristics of a performance by a performer using a water sports implement, while maintaining stability for the vessel, the method comprising the steps of:

providing a vessel behind which the performer is to be towed, the vessel including a bow, a stern, opposing starboard and port sides between the bow and the stern, and an operator station located amidships between the opposing sides;

fitting a skeletal frame at a location proximate the operator station and extending thereabove, the skeletal frame including a first relatively rigid vertical support structure fitted to the starboard side of the vessel abeam the operator station, a second relatively rigid vertical support structure fitted to the port side of the vessel abeam the operator station, and a generally horizontal bridging portion extending between upper portions of the first and second vertically extending support structures at a height substantially above the level of the operator station, the skeletal frame adapted for securing a tow rope thereto;

attaching a tow rope to the upper portion of the skeletal frame for towing the performer therefrom;

fitting a ballast tank onboard and only aft amidships in the vessel;

placing a water scoop in fluid communication with the body of water for forcing water into the ballast tank;

towing the performer by moving the vessel through the body of water; and weighting down the vessel with a desired amount of water deposited into the ballast tank, thus lowering the vessel into the body of water and controlling a wake created by the vessel, the water scoop extracting the water from the body of water as the vessel moves through the body of water.

48. The method according to claim 47, wherein the ballast tank fitting step comprises the step of positioning a lower most portion of the ballast tank at or above the waterline of the vessel when the tank is substantially empty of water.

49. The method according to claim 47, wherein the ballast tank includes an enclosed tank having an opening for venting air to the enclosed tank.

50. The method according to claim 49, further comprising the step of controlling air venting to the ballast tank for affecting water flow into the tank.

51. The method according to claim 47, wherein the ballast tank fitting step comprises the step of fitting starboard and port enclosed ballast tanks.

52. The method according to claim 51, wherein each of the starboard and port enclosed ballast tanks comprises a generally L-shaped tank portion having a first elongated leg fitted beneath quarter gunwales of the vessel and a second leg fitted along an inboard side of the transom of the vessel.

53. The method according to claim 52, further comprising the steps of:

venting each of the starboard and port tanks to air; and controlling air venting to each of the tanks.

54. A method for improving aerial characteristics of a performance by a performer using a water sports implement, the method comprising the steps of:

providing a vessel behind which the performer is to be towed, the vessel including a bow, a stern, opposing starboard and port sides between the bow and the stern, and an operator station between opposing sides;

attaching a tow rope to the vessel for towing the performer therefrom;

fitting first and second enclosed ballast tanks onboard at opposing locations proximate the starboard and port sides, respectively, and only aft amidships in the vessel and positioned such that a lowermost portion of each of the first and second ballast tanks is fitted at or above the waterline of the vessel when each of the first and second tanks are substantially empty of water;

placing a water scoop in fluid communication between the first and second tanks and the body of water for forcing water into each of the ballast tanks as the vessel moves through the body of water;

moving the vessel through the body of water;

towing the performer;

extracting water from the body of water and depositing an amount of water into the ballast tanks, thus adding weight aft;

controlling the extracting and thus flow and amount of water deposited into the enclosed tanks by controlling venting of air to the tank; and shaping the wake for use by the performer.

55. The method according to claim 54, wherein the ballast tank comprises starboard and port enclosed ballast tanks.

56. The method according to claim 54, wherein each of the first and second enclosed ballast tanks comprises a generally L-shaped tank having a first elongated leg portion fitted beneath quarter gunwales of the vessel and a second leg portion fitted along an inboard side of the transom of the vessel.

* * * * *